US005421184A

United States Patent [19]

Sendzimir et al.

[11] Patent Number: 5,421,184

[45] Date of Patent: Jun. 6, 1995

[54] ADDITIONAL PROFILE CONTROL FOR CLUSTER MILLS

[75] Inventors: Michael G. Sendzimir, Woodbury; John W. Turley, Oxford; Alexander Datzuk, Waterbury, all of Conn.

[73] Assignee: T. Sendzimir, Inc., Waterbury, Conn.

[21] Appl. No.: 916,909

[22] Filed: Jul. 20, 1992

[51] Int. Cl.[6] ..... B21B 13/14

[52] U.S. Cl. ..... 72/241.4; 72/242.4

[58] Field of Search ..... 72/241.4, 242.4

[56] References Cited

U.S. PATENT DOCUMENTS

| | | | |
|---|---|---|---|
| 2,169,711 | 8/1939 | Sendzimir . | |
| 2,187,250 | 1/1940 | Sendzimir . | |
| 2,479,974 | 8/1949 | Sendzimir et al. . | |
| 2,776,586 | 1/1957 | Sendzimir . | |
| 3,214,952 | 11/1965 | Eckert | 72/236 |
| 3,815,401 | 6/1974 | Sendzimir et al. . | |
| 3,858,424 | 1/1975 | Kajiwara et al. | 72/242.4 |
| 4,289,013 | 9/1981 | Hunke . | |

FOREIGN PATENT DOCUMENTS

| | | | |
|---|---|---|---|
| 0476905 | 3/1992 | European Pat. Off. | 72/242.4 |

*Primary Examiner*—Lowell A. Larson

*Assistant Examiner*—Thomas C. Schoeffler

*Attorney, Agent, or Firm*—Frost & Jacobs

[57] ABSTRACT

A crown adjustment system for a 20-high (1-2-3-4) cluster mill comprising rack-actuated crown adjustment saddles on the F and G backing bearing assemblies. The F and G saddles are equal in number and located in aligned positions so that the gear rings of an aligned F and G saddle pair can be rotated by a single rack for crown adjustment at that saddle position. The mill has a housing affixed to a base having a bottom and supported on a foundation with a trench extending therethrough. The base bottom covers the trench. Each crown adjustment rack is operatively attached to and actuated by its own hydraulic cylinder mounted within the trench on the base bottom. Each cylinder is provided with a sealing assembly enabling replacement or repair of the cylinder without oil drainage from the base. The F and G shafts are provided with at least one aligned pair of screwdown gears actuated by a screwdown rack attached to a rod actuated by at least one hydraulic screwdown cylinder. The at least one screwdown cylinder is located on one of the mill housing, the base bottom within the trench or a pedestal mounted on the base bottom within the trench.

17 Claims, 5 Drawing Sheets

ADDITIONAL PROFILE CONTROL FOR CLUSTER MILLS

TECHNICAL FIELD

The invention relates to profile control for 20-high cluster mills having a 1-2-3-4 roll arrangement, and more particularly to the provision of profile control and a drive system therefor on the F and G backing bearing assemblies.

BACKGROUND ART

This invention relates to 20-high cluster mills used for the cold rolling of metal strip, and having a 1-2-3-4 roll arrangement as shown in U.S. Pat. Nos. 2,169,711; 2,187,250; 2,470,974; 2,776,586 and 4,289,013, such mills being commonly known as "Sendzimir" mills, "Z" mills or "Sendzimirs".

The invention is particularly concerned with improved additional means for shaping the profile of the rolling mill to the profile of the strip, in order to achieve uniform elongation at every point across the width of the strip, thus enabling uniform tension distribution, and strip of good flatness.

An exemplary cluster mill of the type to which the present invention is directed is shown in FIG. 1. A pair of work rolls 12, through which the strip 32 passes during the rolling process is supported by a set of four first intermediate rolls 13, which are in turn supported by a set of six second intermediate rolls consisting of four driven rolls 15 and two non-driven, or idler rolls 14. The second intermediate rolls are supported in their turn by eight backing assemblies (see also FIG. 2) each consisting of a plurality of roller bearings 30 mounted upon a shaft 18, the shaft 18 being supported at intervals along its length by saddles, each saddle consisting of a ring 31 and a shoe 29 (these parts being bolted together). The saddle shoes 29 rest in a series of partial bores in a mill housing 10, of the type generally described in U.S. Pat. No. 3,815,401.

FIG. 1 is an elevational view of the cluster mill as seen from what is usually referred to as the "front" of the mill or the "operator's side" of the mill. It is normal practice to label the backing assemblies and their components as shown in FIG. 1, where the leftmost upper assembly is labelled "A", and working clockwise around the mill, the remaining assemblies are labelled "B" through "H". This naming convention will be followed in this specification and the claims, being applied to both the backing bearing assemblies and their constituent parts.

In general, all of the saddles on all eight backing assemblies include eccentrics, which are keyed to the respective shafts, and provided with bearing surfaces on their outside diameters, which engage with bores in the saddle rings 31, such that rotation of the respective shafts will cause radial motion of shafts and of bearings mounted thereon.

In the case of assemblies A, D, E, F, G and H, the saddles are known as "plain saddles" and eccentrics 23 mount directly within saddle rings 31, and slide within these rings as the respective shafts are rotated. In such cases, because the friction between the sliding surfaces is high, shafts will not be adjusted under load (i.e. during rolling). A, D, E and H shafts eccentrics are known as the "side eccentrics". Rotating these shafts is used to adjust the radial position of their bearings to take up wear on rolls 12 through 15.

F and G shaft eccentrics are known as the "lower screwdown eccentrics". Rotation of F and G shafts and their eccentrics can be used to take up for roll wear also, but is more frequently used to adjust the level of the top surface of lower work roll 12. This is known as "adjusting the pass line height" or "pass line adjustment".

In the case of assemblies B and C, the saddles are known as "roller saddles". For small mills (which have no crown adjustment) the construction is the same as for the plain saddles, with the exception that a single row of rollers is interposed between the outside of each eccentric and the inside of the mating saddle ring 31. This enables the shafts and the eccentrics keyed thereto to roll within saddle rings 31. The friction is then sufficiently low for adjustment to be made under load. This adjustment is known as the "upper screwdown" or "screwdown" and is used to adjust the roll gap (gap between work rolls 12) under load. The method adopted, as is well known in the art, is to use two double racks 21, one engaging gears 22 on shafts B and C at the operator's side, and one engaging gears 22 on shafts B and C at the drive side (see FIG. 2). Each double rack is actuated by a direct acting hydraulic cylinder 20, and a position servo is used to control the position of the hydraulic pistons, and so control the roll gap.

For larger mills (and for some newer small mills) provision is made for individual adjustment of the radial position of the shaft, bearings and eccentric rings at each saddle position. This adjustment is known as "crown adjustment" and the prior art construction used to achieve it is shown generally in FIGS. 3 through 6.

On the B and C saddles 20, the saddle rings 31 are provided with a larger diameter bore 32, so that a second set of rollers 33 and a ring 34 (the outside diameter of which is eccentric relative to its inside diameter) can be interposed between saddle ring 31 and rollers 37. Rings 34 are known as "eccentric rings". A gear ring 38, having gear teeth 40, is mounted on each side of each eccentric ring 34, and rivets 39 are used to retain gear rings 38, eccentric 23, eccentric ring 34, saddle ring 31 and shoe 39, with two sets of rollers 33 and 37, together as one assembly, known as the saddle assembly.

As shown in FIGS. 3 and 4, a double rack 41 is used at each saddle location, to engage with both sets of gear teeth 40 on each gear ring 38 on both B and C saddle assemblies. A hydraulic cylinder 42, or motor driven jack, is used at each saddle location in order to translate the rack 41. In the example of FIGS. 2 and 6, seven individual drives would be provided, one at each saddle location. These are known as "crown adjustment" drives. If one drive is operated, its respective double rack 41 moves in a vertical direction, rotating the associated gear rings 38 and eccentric rings 34. This causes radial movement of eccentrics 23 on shafts B and C at the saddle location on which the eccentric rings rotate, and a corresponding change in the roll gap at that location, shafts 18 bending to permit this local adjustment.

Although independent drives are provided at each saddle location, the adjustment is not truly independent, due to the transverse rigidity (i.e. resistance to bending) of each shaft 18.

Copending application Ser. No, 071,917,157, filed Jul. 29, 1992, in the names of Michael G. Sendzimir and John W. Turley and entitled IMPROVED PROFILE ADJUSTMENT FOR CLUSTER MILLS, teaches various embodiments of backing bearing assemblies and second intermediate idler rolls characterized by greatly reduced transverse rigidity enabling more complex roll gap profiles to be achieved. The teachings of this copending application are adaptable to the present invention, as will be apparent hereinafter, and are incorporated herein by reference.

The above-noted copending application states that such double eccentrics could also be used to provide crown adjustment on backing bearing assemblies F and G, but that this has never been done, due to the difficulties of access to the crown adjustment drive which would normally need to be attached to the bottom of the mill housing, in an area which is flooded with oil during mill operation, and is very uncomfortable for maintenance personnel to work in due to tight space, slippery surfaces and constant dripping of oil from overhead.

It is the object of the present invention to provide a profile adjustment drive system operating via eccentric rings on the F and G backing assemblies, which is not subject to the accessibility problems of prior art drive systems.

DISCLOSURE OF THE INVENTION

According to the invention there is provided a 20-high (1-2-3-4) clustermill having a mill housing with a roll cavity containing upper and lower roll clusters, each cluster comprising a work roll, two first intermediate rolls, three second intermediate rolls, and four backing bearing assemblies. The mill housing has an operator's side and a drive side. The upper cluster backing bearing assemblies are designated A through D, and the lower cluster backing bearing assemblies are designated E through H, as viewed from the operator's side of the mill and in a clockwise direction. A base is provided for the mill housing. The mill housing is affixed to the base. The base has a bottom. A foundation is provided, having a trench extending transversely therethrough. The base is mounted on the foundation, with the base bottom forming a cover for the trench.

Means are provided for circulating coolant oil through the mill. The base and its bottom collect the coolant oil, draining from the mill, and direct it to the circulating means therefor.

The central pair B–C of the upper backing bearing assemblies is provided with crown adjustment means, as is well known in the art. In this instance, however, the central pair F–G of the lower backing bearing assemblies is also provided with crown adjustment means. To this end, each of the backing bearing assemblies F and G comprises a shaft supported against the mill housing at a plurality of locations along its length by saddle assemblies, with a bearing mounted between each adjacent pair of saddle assemblies. Each saddle assembly comprises a shoe abutting the mill housing and a projecting ring having a circular opening therein through which the shaft passes. A plurality of eccentrics are keyed to the shaft, with each eccentric located within the circular opening of one of the saddle rings. The crown adjustment means at each saddle assembly comprises an eccentric ring located within the circular opening of the saddle ring and between the saddle ring and shaft eccentric, its outer edge contacting the inner edge of the saddle ring, and its inner edge contacting the outer edge of the shaft eccentric. The eccentric has affixed to each of its sides a gear ring. The gear rings of each eccentric ring are provided with aligned sets of gear teeth.

The saddle assemblies of the F & G backing bearing assemblies are equal in number and are aligned. The eccentric rings of each aligned pair of F & G saddle assemblies are engaged by a rack, vertical movement of which will cause rotation of the eccentric rings causing bending of the F & G shafts at that saddle position with resultant crown adjustment of the work roles. Each of the racks at the position of each aligned pair of saddle assemblies is operatively connected to its own respective drive means mounted within the trench on the under side of the base bottom. Sealing means are provided for each drive means enabling it to operate and to be repaired or replaced without leakage of coolant oil into the trench.

The shafts of the F & G backing bearing assemblies are provided at one end with an aligned pair of screwdown gears, both actuated by a single rack. The rack, itself, is actuated by a hydraulic cylinder mounted on the mill housing. Where a clearance problem arises between the lower screw down rack and cylinder assembly and the adjacent saddle pair rack and drive assembly, a spaced pair of hydraulic cylinders interconnected by a crosshead can be used providing adequate clearance, as will be described hereinafter. Alternatively, the double cylinder arrangement may be mounted within the trench on the base bottom rather than on the mill housing, or a single cylinder arrangement for the lower screw down can be mounted on a pedestal depending downwardly in the trench from the base bottom.

In another embodiment of the present invention, each saddle assembly may have a set of rollers between the eccentric and the eccentric ring and a set of rollers between the eccentric ring and the saddle ring. This so reduces friction that the crown adjustment system of the F & G backing bearing assemblies can be actuated during a rolling operation. In this instance, however, each of the shafts of the F & G backing bearing assemblies must be provided with a lower screw down gear at each end with actuating cylinders of any of the types just described and located in any of the positions just set forth, for actuating both, and a position servo to control the positions of the hydraulic pistons, to ensure that they do not move under load.

DETAILED DESCRIPTION OF THE INVENTION

Figure 2:
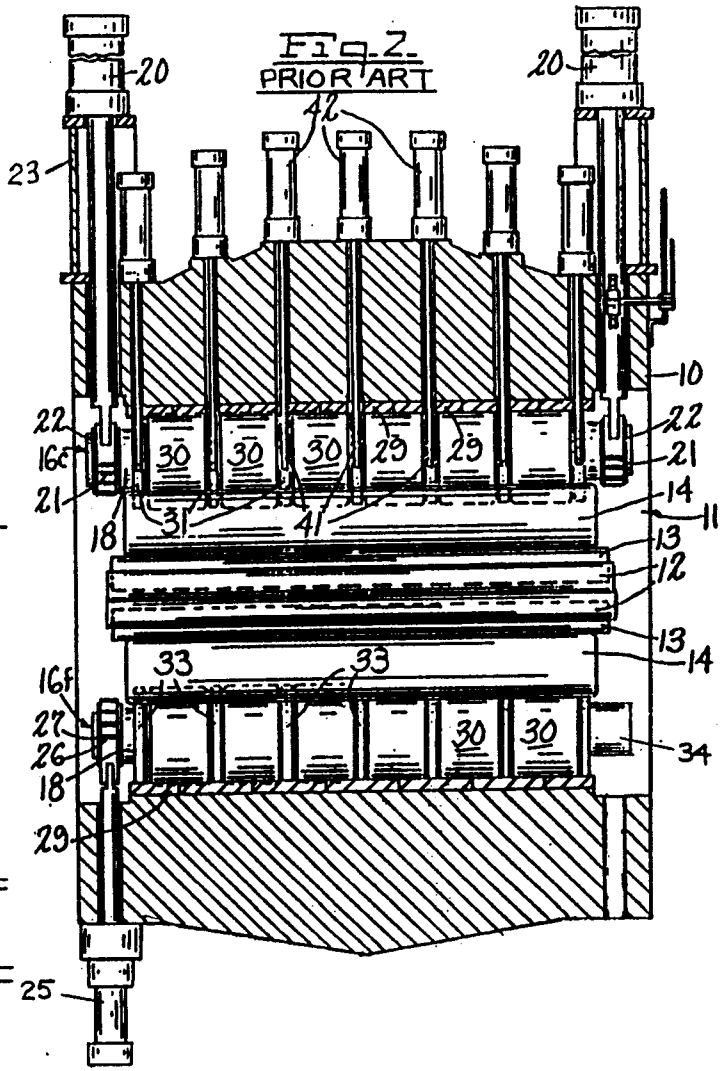
Fig. 2 PRIOR ART
FIG. 2 is a simplified cross sectional view of the mill housing taken along section line 11—11 of FIG. 1, and showing the screwdown and passline adjustment mechanism.
Figure 1:
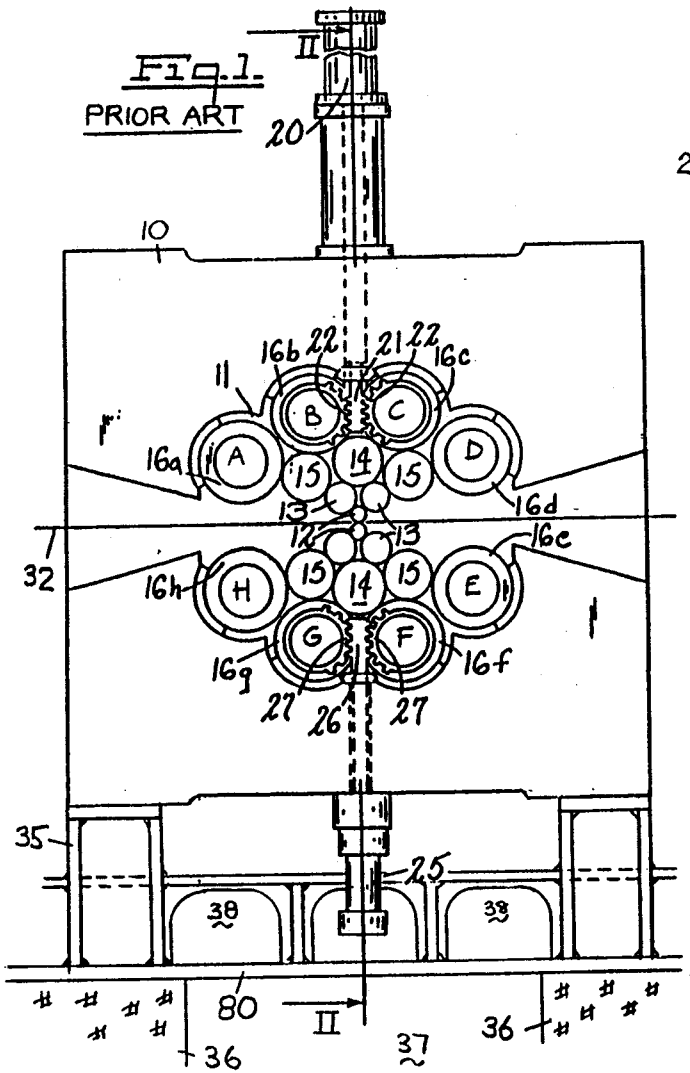
Fig. 1 PRIOR ART
FIG. 1 is a simplified elevational view of a prior art 20-high cluster mill housing and base, with the operator's side screwdown and passline adjustment mechanism removed for purposes of clarity.

An exemplary prior art 20-high cluster mill of 1-2-3-4 construction is shown in FIGS. 1 and 2. Metal strip 32 is rolled by passing it between a pair of work rolls 12. Each work roll is backed up by two first intermediate rolls 13 which, in turn, are backed up by three second intermediate rolls consisting of two outer driven rolls 15 and a center non-driven (or idler) roll 14. The second intermediate rolls are backed up by four backing assemblies, 16*a*–16*d* (upper) and 16*e*–16*h* (lower), each of which consists of a plurality of caster bearings 30 mounted on a shaft 18. The shaft 18 is supported at intervals along its length by saddles consisting of saddle rings 31 and saddle shoes 29, the saddles being supported by mill housing 10, which is usually of monobloc construction.

As indicated above, the backing assemblies 16*a*– 16*h* are conventionally number A through H, starting at the leftmost upper one, and counting in a clockwise direction, as viewed from the operator's side. The B and C backing assemblies (see also FIG. 6) each have saddle rings 31 that are provided with eccentrics 23 which are keyed to the shaft 18 and which all rotate together with gears 22, which are also keyed to the shaft 18, when screwdown racks 21, which are actuated by hydraulic screwdown cylinders 20, are moved. This causes eccentric motion of shafts 18 and bearings 30, which opens or closes the gap between work rolls 12. Saddles 31 are also provided with eccentric rings 34 and rollers 37 and 37*a* which surround the eccentrics, and which have gear rings 38 engagable with racks 41, operated by cylinders 42 (see FIGS. 2, 3 and 5). Racks 41 are double racks (similar to racks 21) and each rack engages with the geared eccentric rings 38 of both backing bearing assemblies B and C (see FIGS. 3 and 4). Cylinders 42 may each be independently operated to adjust the roll gap in line with the cylinder due to the resultant eccentric motion of shaft and bearings in line with the cylinder, thus providing a means of adjusting the profile of the roll gap.

Such mills are usually provided with a pass line height adjustment system, also known as the lower screwdown which acts in a similar fashion to the upper screwdown.

Backing assemblies F and G each have saddles comprising saddle shoes 29 and saddle rings 37*a* that are provided with eccentrics (not shown) similar to eccentrics 23 and keyed to shaft 34 so as to rotate together with passline adjustment gears 27, which are also keyed to shaft 34, when lower screwdown rack 26 is raised or lowered by lower screwdown cylinder 25 (see FIG. 2). This causes eccentric motion of shafts 34 and bearings 30, which adjusts the height of the top of lower work roll 12, which is the passline height.

Figure 3:
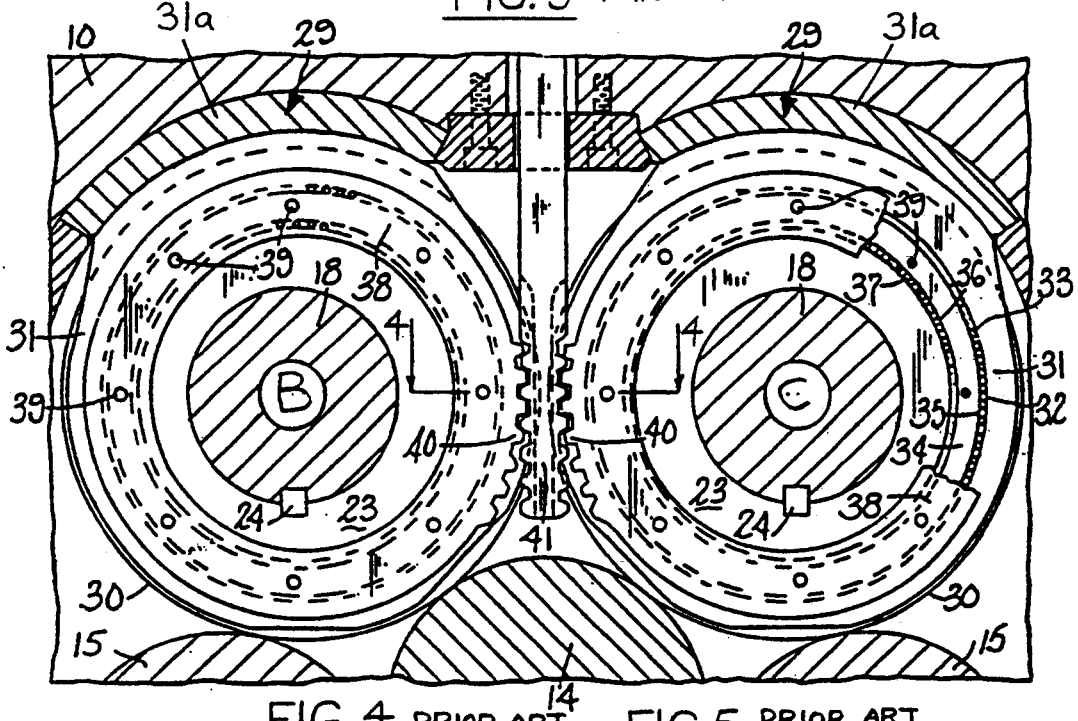
FIG. 3 PRIOR ART
FIG. 3 is a fragmentary elevational view, partly in cross section, of prior art backing assemblies B and C of a 20-high cluster mill.
Figure 4:
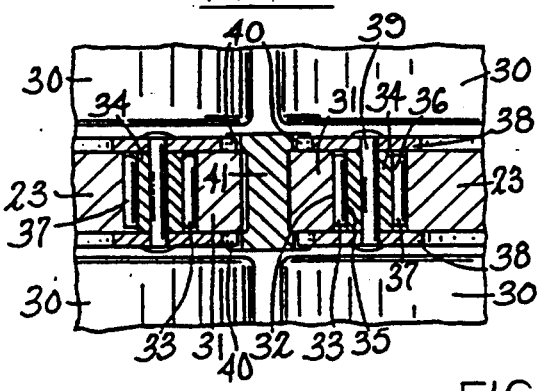
FIG. 4 PRIOR ART
FIG. 4 is a fragmentary cross sectional view taken along section line 4—4 of FIG. 3 showing engagement of one crown adjusting rack and its respective gears, according to the prior art.
Figure 5:
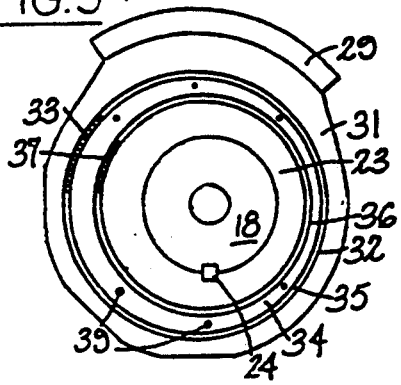
FIG. 5 PRIOR ART
FIG. 5 is a cross sectional view of a typical B and C saddle assembly according to the prior art.
Figure 6:
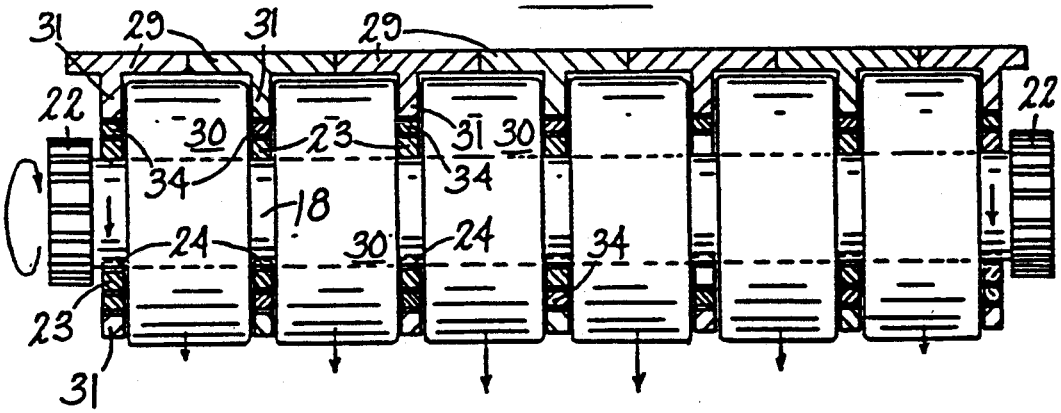
FIG. 6 PRIOR ART
FIG. 6 is a longitudinal cross sectional view of a typical prior art B or C backing assembly having six bearings and seven saddles.

As shown in FIGS. 3, 4 and 5, the B and C backing assemblies are equipped with roller saddles that is, where rollers 37 are fitted between the eccentric 23 and the eccentric ring 34, and rollers 37*a* are fitted between the eccentric ring 34 and the saddle ring 31. This provides the necessary low friction for both screwdown and crown adjustment to be carried out under load, during operation of the mill, when a high separating force arises between upper and lower work rolls 12, as the metal strip 32 is rolled therebetween.

The F and G backing assemblies, on the other hand, have heretofore always been equipped with plain saddles, where the eccentrics are fitted directly in the bores of the saddle rings, with metal to metal contact. In this case the friction is high enough to "lock" the eccentrics under load, and the lower screwdown cylinder 25 is only operated when there is no load i.e. a gap exists between the work rolls 12, and the cylinder's position can be controlled with a simple hydraulic directional valve. Thus the lower screwdown only requires one relatively small diameter cylinder 25, whereas the upper screwdown, which must work under load, requires two larger cylinders 20, each one connected to a rack 21 which mates with a pair of screwdown gears 22 at each end of the B and C shafts. Moreover, the cylinders must be controlled by a closed loop position servo, to maintain position under load.

The mill housing 10 rests upon a mill base 35 to which it is bolted. The purpose of the base is to spread the weight of the mill housing 10 and its internal components over as large an area of the foundation 36 as possible. The base 35 is also used to collect the coolant oil which is sprayed into the mill to cool and lubricate rolls, bearings and strip, in large quantities (for example 1000 gallons/minute or more for a mill rolling 50" wide strip). It is normal to provide a trench 37 in the foundation underneath the mill base 35, the trench 37 being used primarily for a large drain pipe (which could be of 16 in. diameter or more) which returns the oil from the mill base 35 to the recirculating coolant oil filtration system (not shown), where it is cooled, filtered and returned to the mill. Arches 38 are commonly incorporated in the structure of the mill base 35 to provide the required rigidity of the structure, while allowing oil to flow along the bottom 80 of the base 35 until it reaches the drain opening. The mill base 35 forms a cover 80 for the trench 37, which thus becomes a tunnel, and the floor of the trench 37 is generally at a great enough depth for a man to walk comfortably with his head well below the bottom of the mill base.

Figure 7:
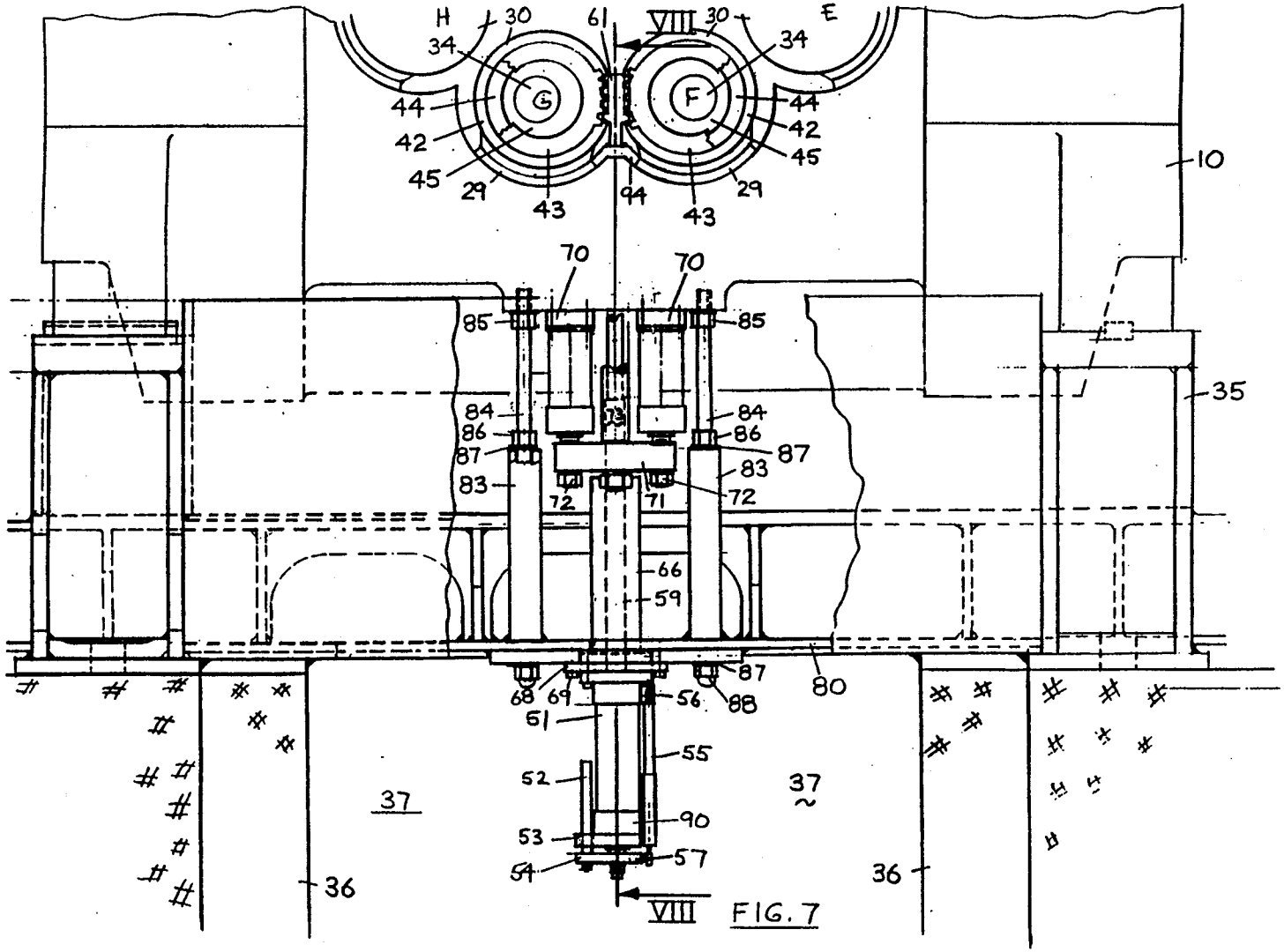
FIG. 7 is a fragmentary elevational view, partly in cross section, illustrating a 20-high cluster mill housing and base according to the present invention.
Figure 8:
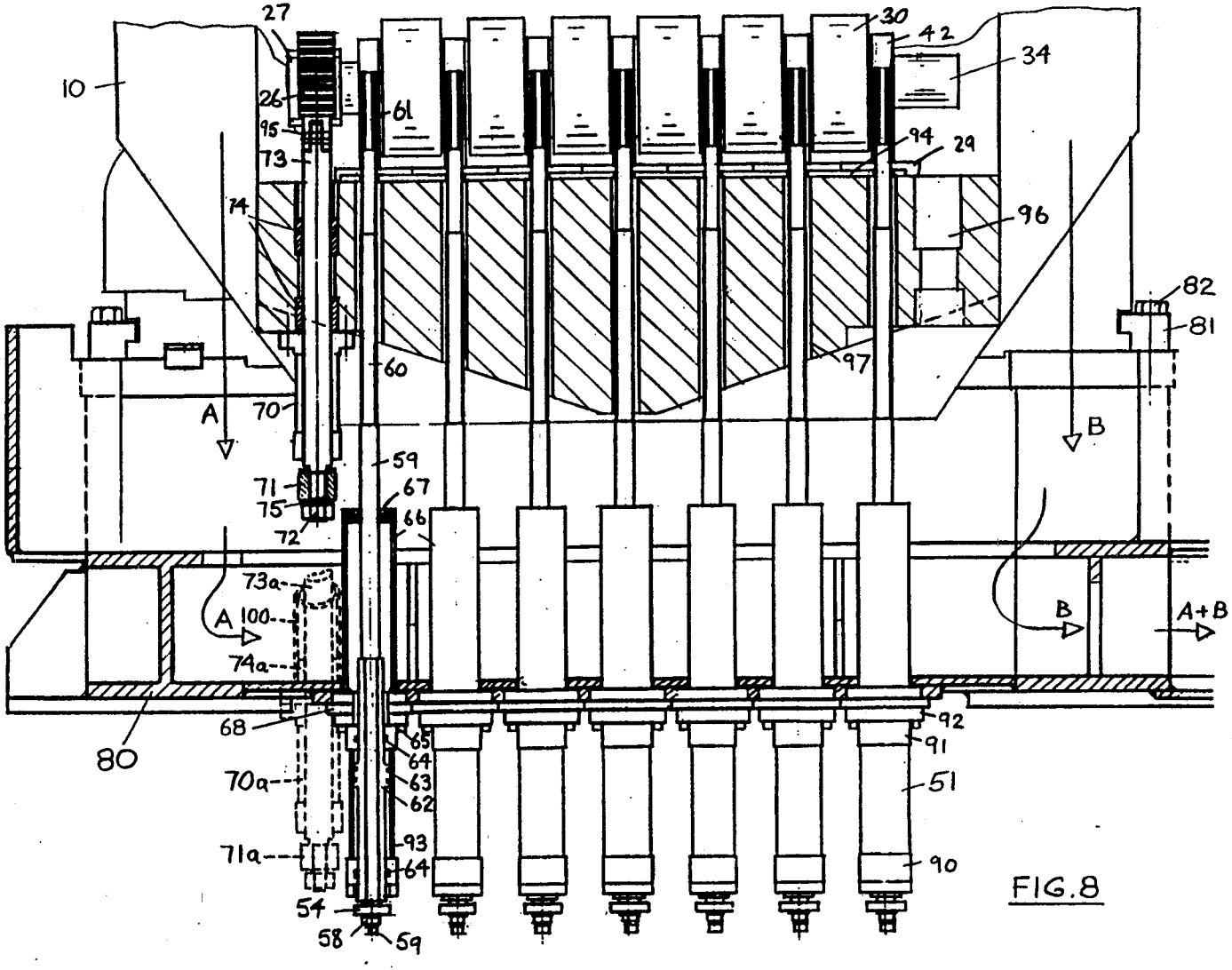
FIG. 8 illustrates a fragmentary center line cross sectional elevation of the mill housing and base taken along the section line VIII—VIII of FIG. 7.

In one embodiment of our invention, shown in FIGS. 7 and 8, mill housing 10 rests upon a fabricated mill base 35, which is supported upon foundation 36, through which trench 37 passes. In this embodiment, which includes 6 backing bearings 30 on each backing shaft, there are seven saddle assemblies mounted on each F and G backing shaft 34, each incorporating saddle ring 42, saddle shoe 29, gear rings 43, an eccentric ring 44 fitting in the bore of saddle ring 42, and an eccentric 45 which fits in the bore of the eccentric ring 44, and is mounted on, and keyed to shaft 34. Each saddle assembly on each of the F and G shafts 34 is similar to that shown in FIG. 5 with the exception that rollers 33 and 37 are not present, there being surface-to-surface contact between the eccentric 45 and the eccentric ring 44, and between the eccentric ring 44 and the saddle ring 42. Screwdown gear 27 mounts on and is keyed to one end of shaft 34. Seven gear racks 61, which are each independently driven, engage with the respective gear rings 43 on the saddle assemblies of F and G shafts. This construction is similar to the prior art construction of B and C shaft assemblies (see FIGS. 1–6), the difference being that only a single screwdown gear 27 is used on each shaft 34 and the saddles are "plain" i.e. there are no rollers, similar to rollers 37*a* and 37 of FIGS. 3–5, between saddle and eccentric rings 42 and 44, or between eccentric ring 44 and eccentric 45.

The mill housing 10 is provided with 7 bored holes 97 through which racks 61, and connecting rods 60 pass. The hydraulic cylinders 51, used for adjustment of racks 61 are each constructed as follows. A hollow piston/double rod 62 passes through the entire length of the cylinder 51, which is constructed of body 93 screwed into ends 90 and 91. Cylinder flange 92, which is part of end 91 is attached to flange 68 by means of bolts 65. Flange 68 is itself attached to the bottom 80 of mill base 35 by bolts 69 (see FIG. 7). Each cylinder 51 is provided with piston seals 63 and rod seals 64. Shouldered connecting rod 59 is provided with a male thread at each of its ends. The upper end screws into connecting rod 60, and the lower end protrudes through the bottom end of piston/double rod 62, to which it is secured by nut 58 with cross head 54 being secured to piston/double rod 62 as the nut 58 is tightened. Guide rod 52 passes through guide flange 53 which is part of lower cylinder end 90, guide rod 52 being secured to crosshead 54 (see FIG. 7). Thus the guide rod prevents rotation of piston/double rod 62, shouldered connecting rod 59, connecting rod 60 and racks 61, once nut 58 is tightened. Guide 94 mounted in mill housing 10, also serves as an anti-rotation device. Guide 94 has a non-circular perforation through which connecting rod 60 extends, the non-circular perforation matching the cross section of connecting rod 60.

Crosshead 54 is also connected to the rod of position transducer 55, via a conventional ball joint 57. The transducer body is mounted to the upper end 91 of cylinder 51 via a conventional ball joint 56.

Each flange 68 is welded to a tube 66, within which a seal 67 is mounted. The seal provides a seal against shouldered rod 59, and prevents oil draining from the mill from entering tube 66.

Operation of each hydraulic cylinder 51 to raise or lower its piston 62 will cause raising or lowering of its rack 61, which will rotate the corresponding gear rings 43 and associated eccentric ring 44 to adjust the mill profile at the corresponding location in the mill.

Sealing gaskets (not shown) are used between flanges 68 and the bottom of mill base 80, and between flanges 92 and 68 to ensure that no oil will drop from the bottom of the base 80.

In FIG. 8 arrows A illustrate the front flow path of oil. Similarly, arrows B illustrate the rear oil flow path through the mill. The front and rear oil flows merge in the mill base 35 and are directed to the above-mentioned drain pipe (not shown) for filtering, cooling and return to the mill.

When it is desired to replace a cylinder 51 (if it is faulty, for example) it is a simple matter to remove the hydraulic connections (not shown), remove bolts 65 and nut 58. The cylinder can then be lowered directly, while shouldered rod 59, connecting rod 60 and rack 61 remain in position. No oil will drain from the mill base at this time because the seals 67 prevent this, regardless of the level of oil in the mill base, and regardless of whether oil is dripping into the base from the mill (which will happen for several hours after the mill stops operating). Thus the job will be very clean and comfortable for the mechanic performing it.

Similarly if it is desired to replace a rack 61 (if it is damaged, for example) this can be done without disturbing its respective cylinder 51 by removing the corresponding nut 58, tieing crosshead 54 to flange 53, and then lifting up rack 61 vertically from inside mill housing 10 (the mill rolls and backing assemblies having first been removed). Because the assembly of rack 51, connecting rod 60 and shouldered rod 59 is too long to be withdrawn in its entirety, rack 61 and connecting rod 60 will be unscrewed from shouldered rod 59 at this point, and removed from the mill separately. The replacement parts can be inserted by the reverse of this process.

The rack 61 closest to the front of the mill (left side of FIG. 8) is very close to lower screwdown rack 26. In some cases this causes difficulty due to the connecting rod 60 and shouldered rod 59 passing very close to the lower screwdown cylinder, which would normally be located on the center line of the mill as is shown at 25 in FIG. 2. In some cases there would be insufficient space for the lower screwdown cylinder 25 unless the shafts 34 of the F and G backing bearing assemblies were extended at the front of the mill, and lower screwdown rack 26 and gears 27 were moved away from said rack 61. Such an extension would be undesirable as it would increase the overhung moment on shafts 34 due to the force applied by lower screwdown rack 26 to gears 27, and would also necessitate increasing the width of the housing in this area—which would increase weight and cost substantially.

In an instance where this problem occurs, lower screwdown cylinder 25 is replaced by a pair of cylinders 70 mounted at the bottom of housing 10 on either side of the mill center line as shown in FIGS. 7 and 8. The piston rods of cylinders 70 are attached to a crosshead 71 using nuts 72 secured to the threaded ends of the piston rods. Rod 73 passes through bushings 74 fitted in a vertical bore in housing 10, and is connected by pin 95 to rack 26, and is secured by its threaded end at the bottom to crosshead 71 using nut 72 and washer 75. Thus operation of cylinders 70 raises or lowers crosshead 71, rod 73 and rack 26, and rotates screwdown gears 27 accordingly. Thus cylinders 70 of FIG. 7 perform the same function as cylinder 25 of FIG. 2, but, because rod 73 is much smaller in diameter than cylinder 25, rack 26 can be placed very close to rack 61, with no interference problem.

Although the embodiment shown in FIGS. 3 and 4 incorporates plain saddles for the F and G backing assemblies, it is also possible to utilize roller saddles, the same as used in the prior art on B and C backing assemblies (see FIGS. 3–6). In such a case, F and G shafts would require screwdown gears 27 to be mounted at both ends, and the lower screwdown assembly of cylinders 70, crosshead 71, rod 73 and rack 26 would be installed at both ends, hole 96 in the second end being provided for this purpose.

Because operation would now be under load as explained above for B and C assemblies, cylinders 70 and 51 would operate at higher loads and so would work at higher pressure and/or be of larger size. In this case the use of the pair of cylinders 70 in place of cylinders 25 would be even more advantageous. The lower screwdown assembly would also be called upon to lock the shafts 34 during crown adjustment.

To avoid the need to make the mill base massive to resist flexure under the forces developed by cylinders 51, it is envisaged that a set of reaction rod assemblies 84 would be mounted between the mill housing and the mill base at several points across the width of the mill. These reaction rod assemblies will rigidize or brace the mill base and it is expected that a pair at the front of the mill as shown in FIG. 7, a similar pair at the back, and a third similar pair at the middle would suffice.

The preferred construction of the reaction rod assemblies is shown in FIG. 7. Tubes 83 are welded to the bottom of the mill base with oil tight welds, and are sufficiently long for their tops to be well above the oil level in the base. Rods 84 are threaded over their entire length and after mounting the mill housing on its base these rods can be inserted through a perforation in the bottom 80 of the mill base 35 and through their respective tubes 83 from below. Upper gasket 87 is applied and nuts 86 and 85 spun on. Then the rods can be screwed into tapped holes in the bottom of housing 10. Next upper gaskets are located at the upper ends of tubes 83, and locking nuts 85 and 86 are tightened. Finally lower gasket 87 and dome nut 88 are installed and tightened from below. This provides a simple, inexpensive and oil-tight assembly which can be removed, if necessary at any time.

In another embodiment the lower screwdown cylinders are mounted underneath the bottom 80 of the mill base 85. In such a case screwdown rack rod **73*a* would extend all the way down through a perforation in the bottom 80 of the mill base 35, and would be provided with a tube 100 and seal (not shown) similar to tube 66 and seal 67 used for shouldered rod 59. The cylinders 70*a* would be identical to those shown in FIG. 7 but would be bolted to the under side of the bottom 80 of the mill base 35. A crosshead 71*a* would again be used to link the piston rods of the two cylinders 70*a* with rod 73*a*, and a third bushing 74*a* would be used to guide rod 73, this bushing being mounted in the bottom of the mill base in the bore of the sealing tube 100 described above. Rod 73*a* would be suitably increased in length as compared to rod 73**.

It is also possible to mount pedestals similar to pedestals 23 in FIG. 2, but inverted, to the underside of the mill base, and use single cylinders substantially identical to cylinders 20, but inverted, mounted to the bottom of the pedestals. Again a sealing tube similar to sealing tube 100 would be used. Such arrangements as this one or that of the second embodiment may be preferred in cases where F and G shafts are fitted with roller saddles, because in this case lower screwdown cylinders would be operable under load, and thus would be provided with position transducers and operated under servo control. The cleaner environment achieved by mounting these cylinders under the mill base would be an advantage in such cases, and these arrangements also provide improved accessibility to the lower screwdown cylinders.

Figure 9:
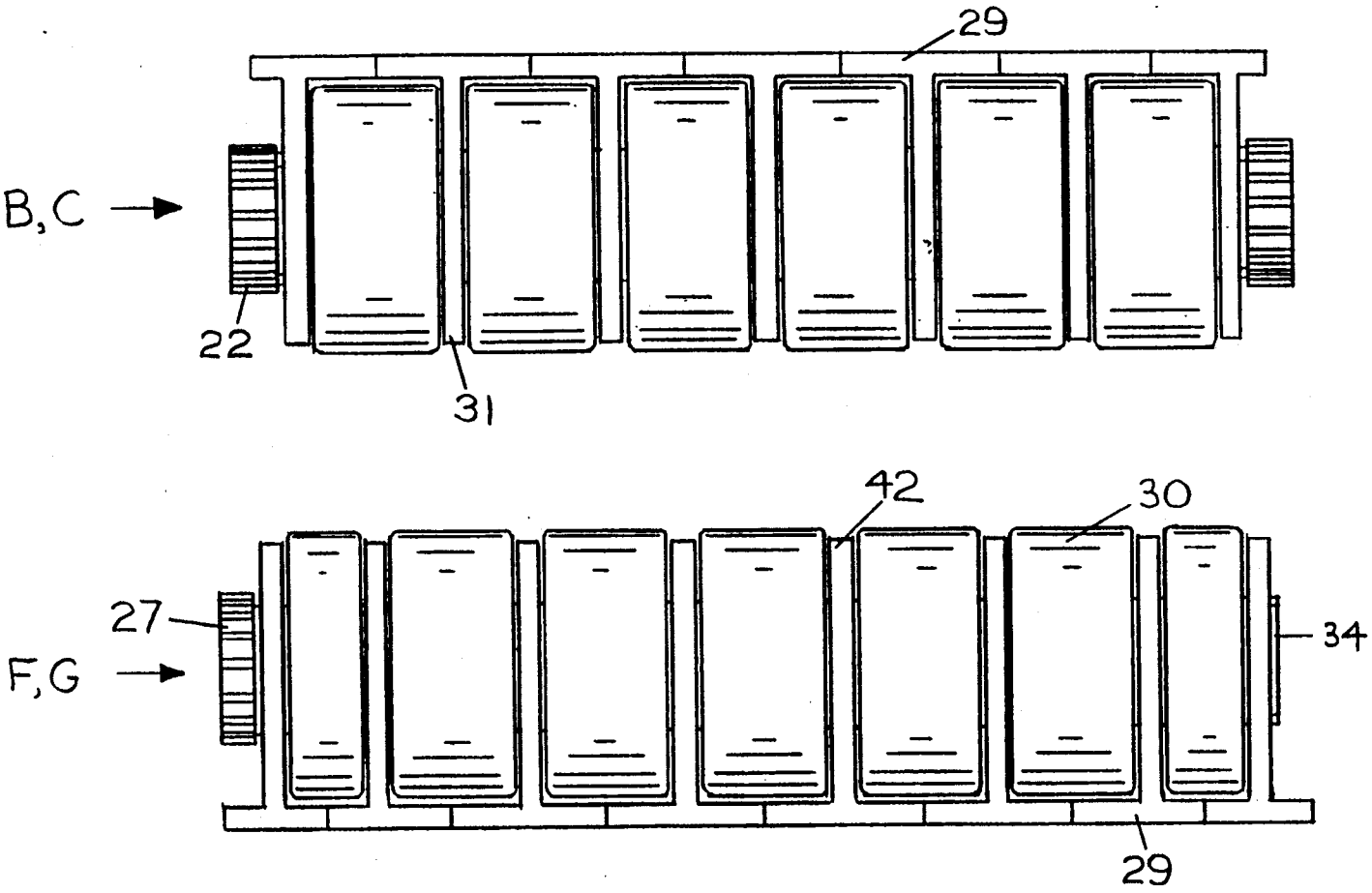
FIG. 9 is a longitudinal elevation of the upper (B and C) and the lower (F and G) shaft assemblies, according to one embodiment where an axial offset of the saddles on F and G shafts relative to those on B and C shafts is provided.

In another embodiment of the invention, shown in FIG. 9, the positions of the respective saddle assemblies at F and G locations are axially offset relative to those at B and C locations, by half a pitch. By this means, the number of individual points of adjustment across the width of the mill is more than doubled. In the example of FIG. 9 there are seven sets of saddles on B and C shafts, and a further eight on F and G shafts, this arrangement providing for fifteen points of adjustment, where only seven points would be obtained if this axial offset was not provided.

This enables more complex crown profiles to be achieved, making it easier to adapt the profile of the roll gap to the profile of the strip, and so obtain good strip flatness.

Modifications may be made in the invention without departing from the spirit of it.

What is claimed:

1. A crown adjustment system for a 20-high (1-2-3-4) cluster mill having a mill housing with a roll cavity containing upper and lower clusters, each of said clusters comprising a work roll, two first intermediate rolls, three second intermediate rolls, and four backing bearing assemblies, said mill housing having an operator's side and a drive side, said upper cluster backing bearing assemblies being designated A through D and said lower cluster backing bearing assemblies being designated E through H as viewed from said operator's side and in a clockwise direction, a base for said mill housing, said mill housing being affixed to said base, said base having a bottom, a foundation having a trench therethrough, said base being mounted on said foundation, said base bottom forming a cover for said trench, means for circulating coolant oil through said mill, said base and its bottom further comprising means to collect said coolant oil draining from said mill and to direct said oil to said circulating means, crown adjustment means on said F and G backing bearing assemblies, means to operate said crown adjustment means and means to drive said operating means, said drive means being mounted in said trench to said base bottom.

2. The crown adjustment system claimed in claim 1 including a gap between said work rolls, said gap having a profile, screwdown means on said B and C backing bearing assemblies for adjusting said gap between said work rolls and crown adjustment means on said B and C backing bearing assemblies for adjusting said profile of said roll gap.

3. The crown adjustment system claimed in claim 1 including pairs of reaction rod assemblies mounted between said mill housing and said base at positions across the width of said mill to brace said mill base.

4. The crown adjustment system claimed in claim 1 wherein saddle assemblies of said F and G backing bearing assemblies are axially offset relative to saddle assemblies of said B and C backing bearing assemblies increasing the number of individual points of crown adjustment across the width of said cluster mill.

5. The crown adjustment means claimed in claim 1 wherein each of said F and G backing bearing assemblies comprises a shaft, a plurality of bearings mounted on said shaft, said plurality of bearings including outermost bearings and intermediate bearings therebetween, said crown adjustment means comprising a saddle assembly between adjacent bearings and alongside said outermost ones of said bearings on said F and G shafts, each saddle assembly comprising a saddle shoe, a saddle ring affixed to said shoe and having a circular inner surface, an eccentric ring having a circular outer surface cooperating with said circular inner surface of said saddle ring and an eccentric inner bore defining an eccentric inner surface, and an eccentric keyed to said shaft and having an outer surface cooperating with said inner surface of said eccentric ring, said eccentric ring having a gear ring affixed to each side thereof, said gear rings having aligned teeth, said bearings of said F and G backing bearing assemblies and said saddle assemblies of said F and G backing bearing assemblies being equal in number and aligned, said means to operate said F and G crown adjustment means comprising a double rack engaging the teeth of said gear rings of each corresponding aligned pair of F and G saddle assemblies, said drive means comprising an independently controlled hydraulic cylinder/piston assembly for each double rack mounted on said base bottom within said trench, and said operating means connecting each of said double racks to its respective hydraulic cylinder/piston assembly.

6. The crown adjustment system claimed in claim 5 including screwdown means on said B and C backing bearing assemblies for adjusting a gap between said work rolls and crown adjustment means on said B and C backing bearing assemblies for adjusting a profile of said roll gap.

7. The crown adjustment system claimed in claim 5 wherein each hydraulic cylinder/piston assembly and its connecting means comprise a cylinder having first and second ends, said first cylinder end terminates in a first flange, a second flange, said first flange being bolted to said second flange, said second flange being bolted to said base bottom about a perforation therein coaxial with said cylinder, sealing gaskets being located between said second flange and said base bottom and between said first flange and said second flange, said cylinder having ports for hydraulic fluid adjacent its ends, said piston having a piston rod with portions extending from both sides thereof and respectively through said first and second ends of said cylinder, said piston rod terminating in a first end beyond said first cylinder end and a second end beyond said second cylinder end, seals mounted on said piston and sealingly engaging said cylinder, seals mounted at said cylinder first and second ends sealingly engaging said piston rod, a tube coaxial with said cylinder, a first end of said tube being welded to said second flange, said tube extending through said base bottom perforation, said tube terminating in a second end, said piston rod first end extending into said tube, a first connecting rod having a first elongated body portion and a second elongated body portion of lesser diameter forming a shoulder therebetween, said first and second connecting rod body portions terminating in threaded free ends, said second body portion of said first connecting rod passing through an axial bore in said piston and piston rod with said shoulder of said first connecting rod abutting said first piston rod end and a nut threadedly engaged on said second body portion free end operatively abutting said piston rod second end, said first body portion of said first connecting rod passing through a seal in said tube second end and into a bore formed in said mill housing, a second connecting rod having first and second ends being located in said mill housing bore, said free end of said first portion of said first connecting rod being threadedly engaged in said first end of said second connecting rod, said second end of said second connecting rod being connected to one of said double racks, and means to prevent undesired rotation of said piston, piston rod, first connecting rod, second connecting rod and said rack.

8. The crown adjustment system claimed in claim 7 wherein, in each of said F and G saddle assemblies, rollers are located between said circular inner surface of said saddle ring and said circular outer surface of said eccentric ring and between the eccentric inner surface of said eccentric ring and said outer surface of said keyed eccentric, said rollers being held in place by said gear rings affixed to each side of said eccentric ring.

9. The crown adjustment system claimed in claim 7 including screwdown means on said B and C backing bearing assemblies for adjusting a gap between said work rolls and crown adjustment means on said B and C backing bearing assemblies for adjusting a profile of said roll gap.

10. The crown adjustment system claimed in claim 7 wherein in each of said F and G saddle assemblies said circular inner surface of said saddle ring and said circular outer surface of said eccentric ring are in direct contact, and wherein said eccentric inner surface of said eccentric ring is in direct contact with said outer surface of said keyed eccentric.

11. The crown adjustment system claimed in claim 10, wherein said cluster mill has a pass line, a single screwdown gear keyed to each of said F and G shafts near the same ends thereof, said screwdown gears being aligned opposite each other, a double rack engaging both of said screwdown gears, cylinder and piston means being mounted on said mill housing for shifting said rack longitudinally to rotate said screwdown gears, said F and G shafts, and said eccentrics keyed thereto to adjust the height of said pass line of said cluster mill.

12. The crown adjustment system claimed in claim 11 wherein said mill housing has a bottom and a vertical center line, said cylinder and piston means comprises a pair of cylinders mounted on said bottom of said mill housing on the same side thereof as said F and G screwdown gears and to either side of the mill housing vertical center line so as not to interfere with an adjacent one of said crown control drive and connecting means, each of said cylinders of said pair having a piston and piston rod, a crosshead, said piston rod of each piston being connected to said cross head, a connecting rod located in a bore in said mill housing being affixed at one end to said cross head and at its other end to said screwdown gear engaging rack.

13. The crown adjustment system claimed in claim 10, wherein said cluster mill has a pass line, a screwdown gear keyed on each of said F and G shafts near each end thereof, said screwdown gears at corresponding ends of said F and G shafts forming aligned opposite pairs, a double rack engaging each aligned pair of F and G screwdown gears, cylinder and piston means being mounted at each side of said mill housing for each rack for simultaneously shifting the racks longitudinally to impart rotation to said F and G screwdown gears, said F and G shafts, and their respective keyed eccentrics to adjust the height of said pass line of said cluster mill.

14. The crown adjustment system claimed in claim 13 wherein said mill housing has a vertical center line, each of said cylinder and piston means comprises a pair of cylinders mounted on a side of said mill housing and to either side of said mill housing vertical center line so as not to interfere with an adjacent one of said crown control drive and connecting means, each of said cylinders of said pair having a piston and a piston rod, a crosshead, said piston rod of each piston of said cylinder pair being connected to said crosshead, a connecting rod located in a bore in said mill housing being affixed at one end to said cross head and at its other end to one of said racks engaging one of said aligned pairs of F and G screwdown gears.

15. The crown adjustment system claimed in claim 14 wherein said mill housing has a bottom, said pairs of cylinders are mounted on said bottom of said mill housing adjacent said operator's side and said drive side thereof.

16. The crown adjustment system claimed in claim 14 wherein said pairs of cylinders are mounted on said base bottom within said trench, each of said rack and cross-head connecting rods extending through a perforation in said base bottom and a tube having a bottom end affixed to said base bottom about said base perforation and a top end sealingly engaging said connecting rod extending therethrough.

17. The crown adjustment system claimed in claim 13 wherein said mill base bottom has an underside, a pair of pedestals mounted to said underside of said mill base bottom within said trench, said cylinder and piston means comprising a pair of cylinders, each located on one of said pedestals and each having a piston rod operatively connected to one of said racks for said screw-down gears.

* * * * *